US005129107A

United States Patent [19]

Lorenzo

[11] Patent Number: 5,129,107

[45] Date of Patent: Jul. 14, 1992

[54] INFLATABLE SAFETY HELMET, SPECIALLY FOR MOTORCYCLING

[76] Inventor: Javier M. Lorenzo, C. Pao Alcover, 08017 Barcelona, Spain

[21] Appl. No.: 590,286

[22] Filed: Sep. 28, 1990

[51] Int. Cl.[5] ..... A42B 3/00

[52] U.S. Cl. ..... 2/413; 2/425

[58] Field of Search ..... 2/410, 413, 425, 2

[56] References Cited

U.S. PATENT DOCUMENTS

| | | | |
|---|---|---|---|
| 3,039,109 | 6/1962 | Simpson | 2/413 |
| 3,462,763 | 8/1969 | Schneider et al. | 2/413 |
| 3,600,714 | 8/1971 | Cade et al. | 2/413 |
| 3,668,704 | 6/1972 | Conroy et al. | 2/413 |
| 3,713,640 | 1/1973 | Margan | 2/413 |
| 3,761,959 | 10/1973 | Dunning | 2/413 |
| 3,787,893 | 1/1974 | Larcher | 2/413 |
| 3,849,801 | 11/1974 | Holt et al. | 2/413 |
| 3,999,220 | 12/1976 | Keltner | 2/2 |
| 4,324,005 | 4/1982 | Willis | 2/413 |

FOREIGN PATENT DOCUMENTS

| | | | |
|---|---|---|---|
| 2823370 | 6/1979 | Fed. Rep. of Germany | 2/413 |
| 3537095 | 7/1986 | Fed. Rep. of Germany | 2/424 |

*Primary Examiner*—Werner H. Schroeder
*Assistant Examiner*—Michael A. Neas
*Attorney, Agent, or Firm*—Steinberg & Raskin

[57] ABSTRACT

It comprises an envelope (1), a couple of independent air chambers (2,3), separated from each other by an inner partition (4) and arranged within the aforementioned envelope (1), an inflating device (5), and a box (6) made up of two complementary members (7,8) joined to the envelope (1).

The inner chamber (3) communicates with the outer chamber (2) through a one-way valve (9), so that the inner chamber (3) stays inflated even if the outer chamber (2) accidentally deflates.

The chambers (2,3) are divided into compartments (10) separated by partitions (11) pierced by small passage holes (12) to obtain a slow deflation in case of accidental leaks.

The outer chambers (2,3) are provided with respective valves (13,14) with an important passage section to obtain quick deflation.

The space occupied in transportation is reduced and blows are cushioned, by maintaining a high safety level. It incorporates the same inflating device (5).

9 Claims, 1 Drawing Sheet

INFLATABLE SAFETY HELMET, SPECIALLY FOR MOTORCYCLING

The present invention concerns a helmet specially for motorcycling.

BACKGROUND OF THE INVENTION

At present we know many kinds of helmets made specially to be used in sports.

They are basically composed of an envelope that covers the head of the person to be protected. This envelope was traditionally made of metallic material, so as to withstand blows. More recently, it has been made of plastic materials, generally with glass fiber for lighter weight, greater elasticity and cushioning with acceptable mechanical resistance and hardness.

These helmets have other advantageous characteristics, such as an elastic inner layer to cushion the effects of blows and to achieve a certain reduction of outside noise, ventilation holes, etc.

Nonetheless, despite the advantages offered by modern helmets used especially in sports, all have the disadvantage of the space they occupy, which is often bothersome.

DESCRIPTION OF THE INVENTION

With the safety helmet of this invention this inconvenience is solved, aside from the added advantage which will be described below.

The safety helmet, specially for motorcycling, is characterized in that it comprises at least one air chamber defined within the envelope.

Thus, the space occupied is greatly reduced when the helmet is not used, since the helmet, once deflated, can be folded and occupies small dimensions.

Advantageously, the helmet of the invention comprises an inflating device of said at least one air chamber joined to the envelope.

Thus, there is no need to carry the inflating device together with the same helmet.

The helmet of the invention also offers other advantages, particularly useful for sports activities, such as motorcycling.

First of all, thanks to the air chamber, it has great capacity for cushioning blows.

In the second place, due to the possibility of deflating it, it is easier to take off in case of accident, since the helmet, once deflated, goes off the head of the person who had the accident.

Thirdly, since it has air in the chambers, it permits the head to float, something very appropriate for risky water sports, such as rafting, canoeing, and wind-surfing.

Finally, due to its characteristics, it can be made with any king of design (integral, half-helmet, fastening with straps and buckles, etc.)

According to a preferred embodiment of the invention, the helmet comprises a couple of independent air chambers, separated from each other by an inner partition, the outer chamber being directly communicated with the inflating device, and the inner chamber being communicated to the outer one through a one-way valve, the inner chamber staying inflated even if the outer one accidentally deflates.

With this double independent chamber arrangement, there's greater safety, since, fi the outer chamber gets torn, the whole helmet won't deflate.

According to the same embodiment, the chambers are divided into compartments separated by partitions pierced by small passage holes through which said compartments are connected to each other, thus obtaining a slower deflation in case of accidental leaks in some point of the at least one chamber.

This characteristic reduces the effects of an accident, if both chambers were accidentally torn.

Another characteristic of the invention is that the at least one chamber is provided with at least one manually driven valve, with an important passage section, to obtain quick deflation of the helmet.

Advantageously, the helmet of the invention comprises a box made up by two complementary members joined to the envelope, so that to keep the envelope folded up, once the helmet has been deflated, inside it.

According to the preferred embodiment, one of the members of the box in which the helmet's envelope is kept, once deflated, is joined on one side to the inflating device and connected, on the other side, to the at least one air chamber, the other member of the box being closed on one side and connected on the other side to the at least one air chamber, both members of the box being provided each with coupling means so that they can be joined together, leaving an inner space in which to keep the helmet's envelope.

The helmet is deflated and introduced, once folded, inside both members that make up the box. Then both complementary members are coupled each other.

Further characteristics of the invention are that at least one quick deflation valve is arranged on the wall of the box, and the inflating device of the at least one air chamber is of the bellows kind, to make folding easier.

The helmet as a whole thus occupies a very small space.

BRIEF DESCRIPTION OF THE DRAWINGS

To better understand what has been stated, we include some drawings which, as an outline and only as a non-limiting example, represent a practical application.

In the drawings.

DESCRIPTION OF A PREFERRED EMBODIMENT

Figure 1:
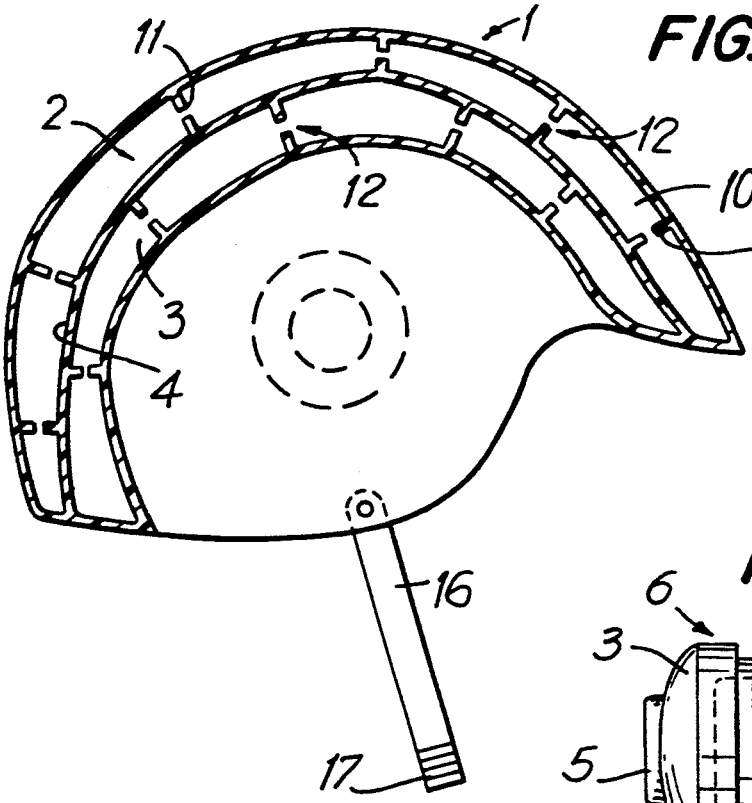
FIG. 1 is a longitudinal section of a preferred embodiment of the invention helmet, once inflated.

As can be seen in the drawings, the safety helmet is made up of an envelope (1), a couple of independent air chambers (2, 3) separated from each other by an inner partition (4), and fixed within the aforementioned envelope (1), an inflating device (5) for the air chambers (2, 3), and a box (6) made up of two complementary members (7, 8) joined to the envelope (1).

The outer chamber (2) communicates directly with the inflating device (5), and the inner chamber (3) is connected to the outer chamber (2) by means of a one-way valve (9). Thus, the inner chamber (3) remains inflated, even if the outer chamber (2) is accidentally deflated.

The chambers are divided into compartments (10), separated from each other by partitions (11) pierced by small passage holes (12) through which the aforementioned compartments (10) communicate with each other. Through these small holes (12) a slow deflation is achieved in case of accidental leaks in some point of the chambers (2, 3).

The chambers (2, 3) are provided with respective manually driven valves (13, 14), with an important passage section to obtain a quick deflation of the helmet. As can be seen, the valves (13, 14) are arranged on the walls of the box (6).

Figure 2:
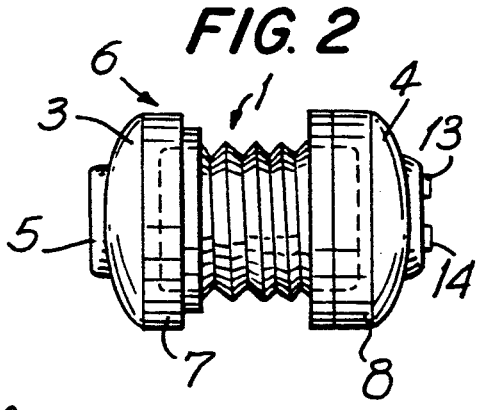
FIG. 2 is a view of the same helmet as in FIG. 1, deflated and being placed inside the box, ready for transportation.

Member (7) of the box (6) is joined on one side to the inflating device (5) and connected on the other side with the outer chamber (2), and member (8) of the box (6) is closed on one side and connected on the other side with the outer chamber (2). Both members (7, 8) of the box 96) are provided with coupling means so they can be joined, leaving an inner space to keep the envelope (1) in the helmet (FIG. 2).

It is understood that the coupling means (not shown) can be of any kind, such as threaded, fitted with pressure, etc.

Figure 3:
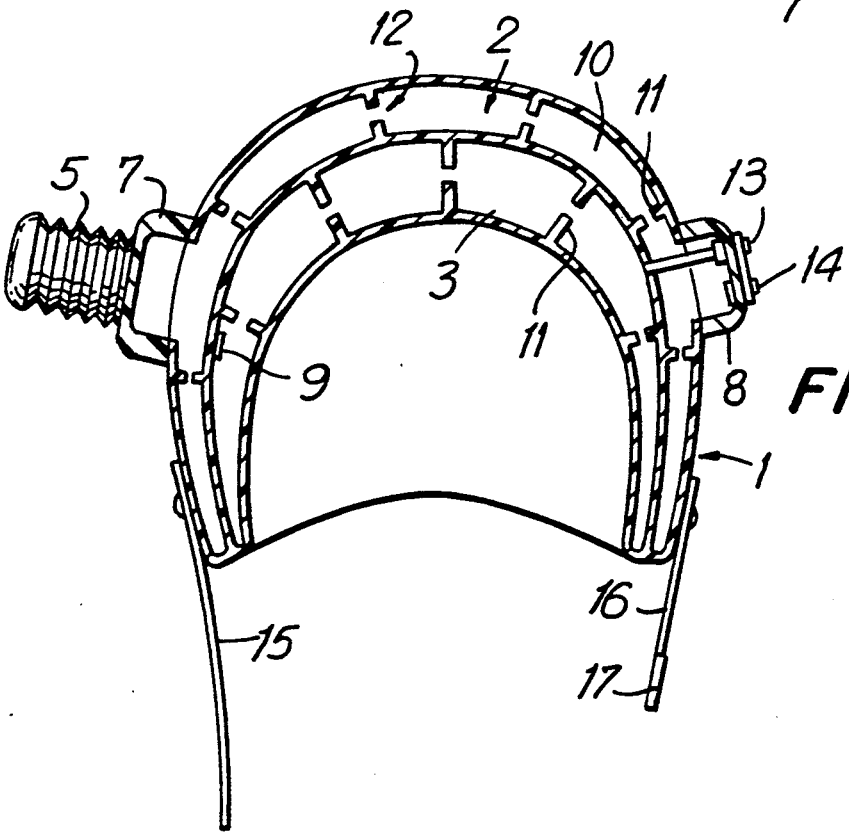
FIG. 3 is a cross section of the same helmet as in FIG. 1, also inflated.

In FIG. 3 it can be seen that the inflating device (5) of the air chambers is of the bellows kind, for easier folding.

FIGS. 1 and 3 also show a straps (15, 16) and buckle (17) system for fastening the helmet.

The way the helmet functions follows from the above descriptions.

For its transportation, the helmet is folded up with the envelope (1) inside the box (60, and the bellows of the inflating device (5) is compressed, as shown in FIG. 2.

The members (7, 8) are separated from the box (6) by loosening the coupling means, and afterwards, the air chambers (2, 3) are inflated, with the aid of the bellow's pump (5) until the helmet is blown up as shown in FIGS. 1 and 3.

For quick deflating, the valves (13, 14) are opened, after which the envelope (1) is introduced in the holes of the compartments (7, 8) of the box (6) and these two members (7, 8) are joined together.

Thus, the helmet, once deflated, is inside the box (6), ready to be transported and occupying a small space.

A helmet specially for motorcycling has been disclosed but it is understood that it can be used in any kind of sport or profession.

The helmet of the invention can be used as described but it can also be covered by a rigid envelope. In this case, the helmet of the invention would act as an inner cushion of a rigid helmet.

I claim:

1. A safety helmet, especially for motorcycling, comprising an envelope (1) adapted to conform to the shape of a human head, said envelope comprising an inner air chamber (3) and an outer air chamber (2), said outer air chamber surrounding said inner air chamber, an inner partition (4) separating said inner and outer air chambers, a one-way valve (9), said outer air chamber communicating to said inner air chamber through said one-way valve such that air from said outer air chamber can flow into said inner chamber, an inflating device (5) directly communicating with said outer chamber, said inflating device including means adapted to inflate said outer air chamber and said inner air chamber, said inner air chamber being adapted to stay inflated in the event that said outer air chamber accidently deflates.

2. Safety helmet wherein said inflating device (5) comprises a bellows, said bellows adapted to fill said outer and inner air chambers with air when said envelope is placed on a user's head such that said outer and inner air chambers provide cushioning protection to the user's head.

3. Safety helmet according to claim 1, wherein said outer and inner air chambers (2, 3) are divided into compartments (10) separated by partitions (11), said partitions having small passage holes (12) through which said compartments are connected to each other, thus obtaining a slower deflation in case of accidental leaks in some point of said outer and/or said inner air chamber (2, 3).

4. Safety helmet according to claim 1, characterised in that at least one of said inner and said outer air chambers (2, 3) of the helmet is provided with at least one manually driven valve (13, 14), with a passage section, to obtain a quick deflation of the helmet.

5. Safety helmet according to claim 1, further comprising first and second complementary members (7, 8), said first complementary member (7) being joined to said inflating device via first coupling means, said second complementary member (8) being attached to an outer wall of said outer air chamber via second coupling means, said envelope being adapted to fit within said complementary members when said inner and outer chambers are in a deflated condition, such that said two complementary members can form a box (6) for storage.

6. Safety helmet according to claim 5, characterised in that one of the members (7) of the box (6) in which the helmet's envelope (1) is kept once deflated, is joined on one side to the inflating device (5), and connected, on the other side to said outer air chamber (2), the other member (8) of the box (6) being closed on one side and connected on the other to the at least one chamber (2), both members (7, 8) of the box (6) being provided each with coupling means so that they can be joined together, leaving an inner space in which to keep the helmet's envelope (1).

7. Safety helmet according to claim 6, characterised in that at least one quick deflation valve (13, 14) is arranged on a wall if the box (6).

8. Safety helmet according to claim 1, characterised in that the inflating device (5) of said outer air chamber (2, 3) is of the bellows kind to make folding easier.

9. A safety helmet, comprising an envelope (1) adapted to conform to the shape of a human head, an inner air chamber (3) surrounding and connected to said envelope, an outer air chamber (2) surrounding and connected to said inner air chamber, an inner partition (4) separating said inner and outer air chambers, a one-way valve (9), said outer air chamber communicating to said inner air chamber through said one-way valve such that air from said outer air chamber can flow into said inner chamber, an inflating device (5) directly communicating with said outer chamber, said inflating device including means adapted to inflate said outer air chamber and said inner air chamber, said inner air chamber being adapted to stay inflated in the event that said the outer air chamber accidently deflates, first and second complementary members (7, 8), said first complementary member (7) being joined to said inflating device via first coupling means, said second complementary member (8) being attached to an outer wall of said outer air chamber via second coupling means, said envelope being adapted to fit within said complementary members when said inner and outer chambers are in a deflated condition, such that said two complementary members can form a box (6) for storage, one of said complementary members (7) being joined to said inflating device, and said other member (8) being connected on an opposite side of said helmet to said outer air chamber, both of said complementary members being provided with coupling means so that they can be joined together, leaving an inner space in which to keep said envelope.

* * * * *